US006457800B1

(12) United States Patent
Böhm et al.

(10) Patent No.: US 6,457,800 B1
(45) Date of Patent: Oct. 1, 2002

(54) METHOD FOR TOLERANCE COMPENSATION IN AN INK JET PRINT HEAD

(75) Inventors: Uwe Böhm; Stephan Günther; Wolfgang Thiel, all of Berlin (DE)

(73) Assignee: Francotyp Postalia AG & Co. K.G., Birkenwerder (DE)

( * ) Notice: Subject to any disclaimer, the term of this patent is extended or adjusted under 35 U.S.C. 154(b) by 0 days.

(21) Appl. No.: 09/205,625

(22) Filed: Dec. 4, 1998

(30) Foreign Application Priority Data

Dec. 4, 1997 (DE) ..... 197 55 874

(51) Int. Cl.[7] ..... B41J 29/393
(52) U.S. Cl. ..... 347/19; 347/19; 347/42
(58) Field of Search ..... 347/19, 40, 41, 347/42, 43, 12, 200

(56) References Cited

U.S. PATENT DOCUMENTS

| | | | | |
|---|---|---|---|---|
| 4,219,822 A | * | 8/1980 | Paranjpe | 347/42 |
| 4,660,552 A | * | 4/1987 | Kaiya et al. | 347/200 |
| 4,675,696 A | * | 6/1987 | Suzuki | 347/19 |
| 4,878,063 A | * | 10/1989 | Katerberg | 347/19 |
| 5,049,898 A | * | 9/1991 | Arthur et al. | 347/19 |
| 5,241,325 A | | 8/1993 | Nguyen | 346/1.1 |
| 5,442,383 A | * | 8/1995 | Fuse | 347/19 |
| 5,534,895 A | * | 7/1996 | Lindenfelser et al. | 347/12 |
| 5,696,541 A | | 12/1997 | Akahane et al. | 347/8 |
| 6,164,746 A | * | 12/2000 | Akahira et al. | 347/15 |

FOREIGN PATENT DOCUMENTS

| | | | |
|---|---|---|---|
| DE | 195 11 416 A1 | | 11/1995 |
| EP | 106625 | * | 7/1981 |
| EP | 0 257 570 A2 | | 3/1988 |
| EP | 0 440 469 A2 | | 8/1991 |
| EP | 0 674 993 A2 | | 10/1995 |
| EP | 0 709 192 A2 | | 5/1996 |
| EP | 0 775 587 A1 | | 5/1997 |
| JP | 57102364 A | * | 6/1982 |
| WO | 95/07185 A1 | | 3/1995 |

OTHER PUBLICATIONS

Anthony G. Poletto, "Full Width Array Angled Thermal Ink Jet Writeheads", Xerox Disclosure Journal, vol. 17, No. 4 Jul./Aug. 1992.

* cited by examiner

*Primary Examiner*—John Barlow
*Assistant Examiner*—Ly T Tran
(74) *Attorney, Agent, or Firm*—Laurence A. Greenberg; Werner H. Stemer; Ralph E. Locher

(57) ABSTRACT

A method for tolerance compensation in an ink jet print head reduces the expense for improving print quality. Therefore, despite the reduced expense, tolerances both within a module and from one module to another should be compensated for. Even before a final installation of the ink jet print head in a printing device, after an assessment of test printouts, initially gaps at transitions from one module to another are compensated for mechanically by rotating the ink jet print head and are stored in memory externally. Then individual print data for the ink jet print head are generated electronically and stored in a nonvolatile manner internally in the print head.

5 Claims, 5 Drawing Sheets

METHOD FOR TOLERANCE COMPENSATION IN AN INK JET PRINT HEAD

BACKGROUND OF THE INVENTION

Field of the Invention

The invention relates to a method for tolerance compensation in an ink jet print head, in particular in an ink jet print head having a plurality of modules on the non-interlaced principle.

Such ink jet print heads are used both in office printers and in small high-speed printers of the kind needed for postage meters and product labeling equipment. As a rule they have a relatively large number of nozzles.

One component with especially great influence on the reliability of a printer is the ink jet print head. If the ink jet print head is assembled from a plurality of components, then the precise disposition of the components relative to one another and with one another, and the ink jet print head itself, all have a definitive influence on its reliable function.

It is known, from the Third Annual European Ink Jet Printing Workshop, Oct. 16–18, 1995, in Maastricht, The Netherlands, to assemble an ink jet print head from three modules on the non-interlaced principle. The ink jet print head is typically triggered by a microprocessor.

Parallel slots of equal length, aligned with one another and extending obliquely, are made in a front panel, and the modules with their nozzle regions are inserted into them, as is also seen in FIG. 1.

A recording carrier is moved past the rows of nozzles in such a way that the printed image is composed of three strips, one above the other. Accordingly, for a vertical solid line, the upper third is created by the first module, the middle third by the second module, and the lower third by the third module.

However, it is also possible, for instance in manual postage meters, for the recording carrier to be stationary and the ink jet print head to be moved, as is seen in Published European Patent Application 0 750 277 A2.

The slots are typically made with high precision in the front panel, and the modules are manufactured as precision parts. Nevertheless, deviations in tolerance of over a tenth of a millimeter, which for a 200 dpi print head with 200 nozzles amounts to about the vertical spacing between two adjacent nozzles, cannot be excluded at the transition from one module to the next. The errors may be errors in spacing and parallelism as well as deviations from the line of alignment within one row of nozzles and in nozzles located one below another. In that respect, reference is made to a simplified example shown in FIGS. 1 and 2 and described in detail below.

A method for calibrating the nozzles of an ink jet print head in ink jet printing devices is known from Published European Patent Application 0 257 570 A2. The ink jet print head is moved bidirectionally past a recording carrier through the use of a drive mechanism. Individual droplets are each expelled from its individually triggerable writing nozzles at fixed printing times during its motion, in accordance with data taken from a drawing generator.

In terms of the method, a trial print run is first performed, during which a defined pattern of lines is printed on the recording carrier, separately for each-individual writing nozzle and each writing direction, that is leftward and rightward.

A scanning run is then carried out, during which the pattern of lines is scanned by an optical sensor disposed on the print head. The sensor is synchronized with a print cycle raster. The scanning values are transmitted, in the raster of the printed columns in a character matrix as an "actual" position, to a central controller of the ink writing device.

A comparison is made in the central controller, through the use of a comparison circuit, between the "actual" and the "desired" positions, which is determined by corresponding trigger pulses. Deviations between the two positions indicate values for a so-called droplet offset in the raster of the printed columns.

The values for the droplet offset for each writing nozzle are stored in memory separately for the two writing directions in an additional memory of the central controller. The droplet offset is sent onward, separately for the writing directions, as a distortion value to a pixel memory which is also contained in the central controller.

Each time a writing nozzle is triggered in the normal printing mode, the value for the droplet offset ascertained for the applicable writing nozzle is taken into account as a function of the writing direction. To that end, in the preparation for the characters, predistortion is performed in accordance with the printing direction and the droplet offset that is ascertained.

Accordingly, in that method, the following are required per ink writing device: one optical scanning sensor, one comparison circuit, two additional memories for droplet offset storage, and two pixel memories. That is a considerable expense for one print.

A further factor is that in ink jet print heads having a plurality of modules, tolerances from one module to another cannot be compensated for in that method. That is because a compensation is only possible chronologically beforehand or afterward along the relative line of motion of the writing nozzle.

A postage meter with an ink jet print head that has many nozzles is also known from Published European Patent Applications 0 702 334 A1 and 0 702 335 A1. The nozzles are disposed in at least two rows, which extend crosswise to the direction of advancement of the print carrier. Those two rows are also offset from one another longitudinally and transversely to the advancement direction, so that some first nozzles on the end of one row of nozzles face some second nozzles on the end of the other row of nozzles. The nozzles in the region of overlap are actuated alternatively. No correction of nozzle spacing is possible therein.

Finally, a computer-controlled ink jet printer that includes a plurality of ink jet print heads is known from German Patent DE 32 36 297 C2. The ink jet print heads are disposed one behind the other in the print carrier transport direction as well as crosswise thereto, one above the other. In that way, the printed image is created by the non-interlaced principle, which was also addressed above. Picture signals are loaded in an external memory device assigned to each individual ink jet print head. Applying the picture signals to the ink jet print heads trips an expulsion of a droplet and thus a printing operation. A time sequence and a controller are used for applying the picture signals. The picture signals are applied, in a proportion adapted chronologically to one another, to the laterally offset ink jet print heads through the use of the controller, in order to print the various lines in the desired mutual orientation. Next, a new set of picture signals for printing the next picture is stored in memory through the use of the controller.

The ink jet printer is provided with a programmable microprocessor, through which the picture signals are assembled in buffer memories assigned individually to the ink jet print heads. The storage of the picture signals in the buffers and the ensuing application thereof to the ink jet print heads are carried out through the use of a central timing and control unit with a course and fine delay device.

The latter device includes detecting the print carriers, such as the front edge thereof, at a certain point along the transport path and ensuing timing of the onset of the printing operation. The distance of the ink jet print heads from that location is known precisely, so that during the period of time between print carrier detection and the onset of the printing operation by an ink jet print head, a buffer assigned to that ink jet print head can be loaded with picture signals. The time interval can be varied through the use of the controller. In that way, the image line created by each ink jet print head on the print carrier can be shifted to the left or right in order to set the desired location of that line. That makes it possible to orient at least the first printed column.

Analogously to the device of Published European Patent Application 0 257 570 A2, an equalization of built-in tolerances of the ink jet print heads is possible, but not from nozzle to nozzle inside one ink jet print head. Spacing errors between the lines can accordingly not be corrected, either.

SUMMARY OF THE INVENTION

It is accordingly an object of the invention to provide a method for tolerance compensation in an ink jet print head, which overcomes the hereinafore-mentioned disadvantages of the heretofore-known methods of this general type, which reduces the expense for improving print quality and with which. deviations both within a module and from one module to another and built-in tolerances of the ink jet print head can all be compensated for despite the reduced expense.

With the foregoing and other objects in view there is provided, in accordance with the invention, a method for tolerance compensation in an ink jet print head, which comprises providing an ink jet print head with a plurality of obliquely disposed and mutually equidistant modules on the non-interlaced principle having first effective nozzles intended to lie on a line orthogonal to a transport direction of a print carrier; assessing test printouts, then mechanically compensating for existing gaps at transitions from one module to another by a rotation of the ink jet print head, and externally storing the gaps in memory as a correction value, before a final installation of the ink jet print head in a printing device; and then controlling the ink jet print head with a printing control computer by electronically generating individual print data as correction data for the ink jet print head and storing the print data in a nonvolatile manner within the ink jet print head.

In accordance with another mode of the invention, there is provided a method which comprises creating a first test printout with print data corresponding to a virtual straight printed line of dots extending orthogonally to the transport direction of the recording carrier; visually checking the test printout for gaps in the printed line of dots at transitional regions of the printed dots generated by the individual modules; rotating the ink jet print head about a shaft with an adjusting device, if gaps are present between applicable printed dots, for closing the gaps between the applicable printed dots; checking an outcome of a second test printout, making another correction if necessary, and mechanically storing the rotation of the adjusting device in memory by setting an adjustment screw in the adjusting device; scanning the printed line of dots with a scanner after a conclusion of a mechanical calibration, delivering scanning signals to the printing control computer and comparing the scanning signals with tripping print data in the printing control computer; storing an outcome of the comparison in memory, in the form of individual print data, in a memory integrated with the ink jet print head and constructed as a nonvolatile read-write EEPROM memory; and using the individual print data, during a printing operation, in the printing control computer to generate corrected clock signals for triggering the ink jet print head.

In accordance with a further mode of the invention, there is provided a method which comprises supplying the corrected clock signals serially and in a module-oriented manner to the ink jet print head.

In accordance with an added mode of the invention, there is provided a method which comprises supplying the corrected clock signals in the form of a parallel bus and in a nozzle-oriented manner to the ink jet print head.

In accordance with a concomitant mode of the invention, there is provided a method which comprises supplying the individual print data with information for excluding a nozzle from a printing operation, if the printed dots overlap because of the rotation of the ink jet print head.

The invention takes as its point of departure the concept of reducing the great expense for equipment and personnel, for the tolerance compensation that was previously required after an ink jet print head had been installed in a printer, by performing this compensation beforehand, externally and centrally, and implementing it in the ink jet print head.

Since individual print data for electronic calibration and installation data for mechanical calibration are stored in memory for each ink jet print head in that ink jet print head, the ink jet print head is already precalibrated before it is installed in the printer. Tolerance compensation between modules is made possible for the first time for ink jet print heads composed of individual modules on the non-interlaced principle, by combining electronic and mechanical calibration.

The auxiliaries, such as scanners and central memory devices, for the calibration, are no longer an integral component of each individual printer but instead are needed only in print head manufacture or suitable service facilities. This is a substantial economy. The expense for nonvolatile memory and an adjusting device that is needed anyway is low.

Once the ink jet print head has been installed in the printer, slight installation tolerances that may still exist can be calibrated as needed through the use of the adjusting device.

Other features which are considered as characteristic for the invention are set forth in the appended claims.

Although the invention is illustrated and described herein as embodied in a method for tolerance compensation in an ink jet print head, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
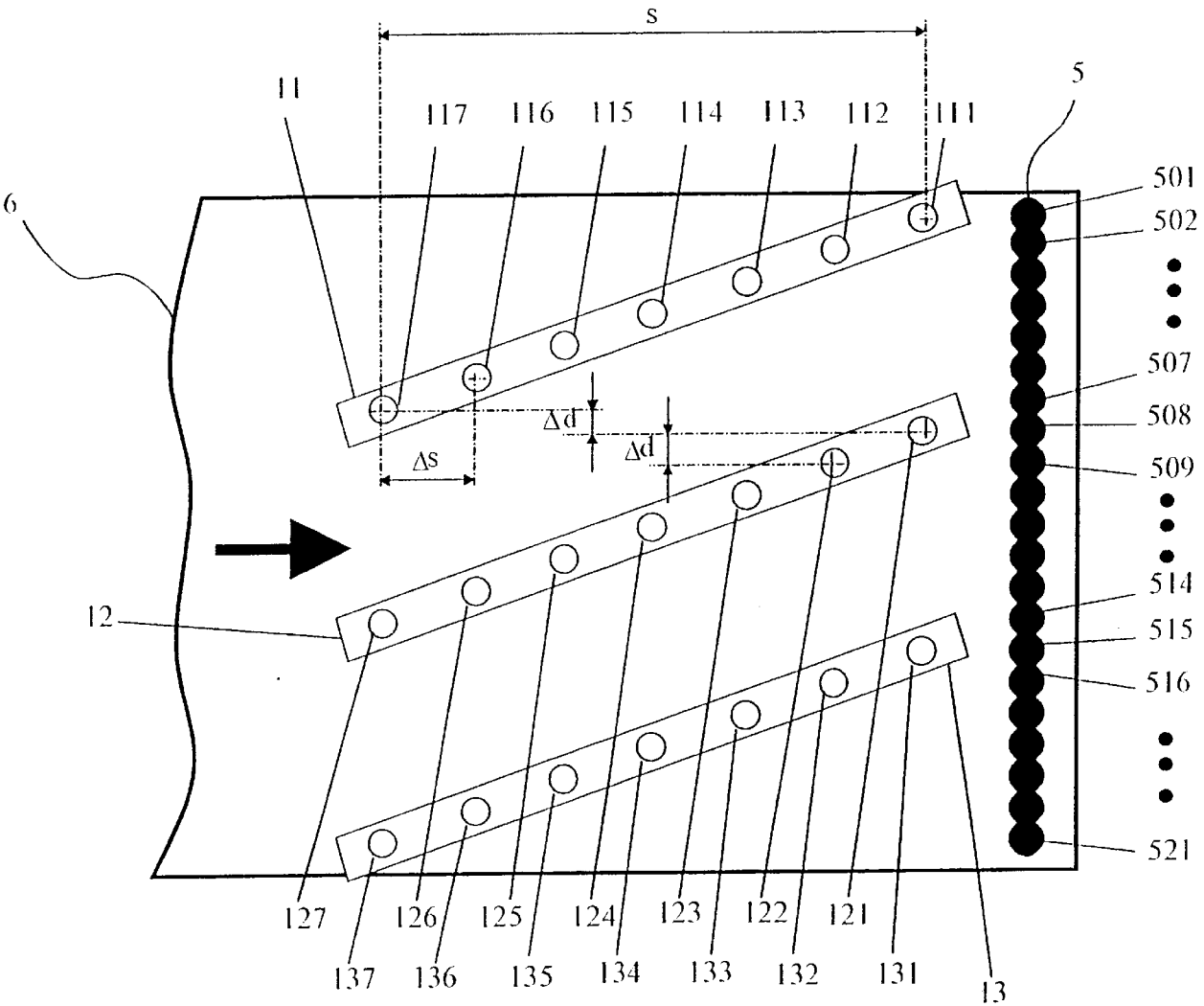
FIG. 1 is a fragmentary, diagrammatic, top-plan view of an error-free nozzle field, with an associated line printed.

Referring now in detail to the figures of the drawings, which are diagrammatic for the sake of simplicity and easier comprehension, and first, particularly, to FIG. 1 thereof, there is seen an error-free nozzle field with an associated line printed. Three modules 11, 12, 13, each having seven respective nozzles 111–117, 121–127, and 131–137, form one ink jet print head. The nozzles in one nozzle row of a module are disposed equidistantly along a line. Nozzles of the same ordinal number, such as the nozzles 111, 121, 131 of the modules 11, 12, 13, are also disposed equidistantly in one row, which is orthogonal to a transport direction of a, recording carrier 6. The transport direction is indicated by an arrow.

The recording carrier 6 in this case is a strip, of the kind typically used for parcels to be mailed. A spacing Ad of the nozzle with the highest ordinal number, such as the nozzle 117 of the module 11, with respect to the nozzle with the lowest ordinal number, such as the nozzle 121, in the next module 12, in the direction orthogonal to the transport direction of the recording carrier 6, is set in such a way that it is equal to a spacing between adjacent nozzles in one row of nozzles in that direction. It can be said that $\Delta d$ is the ideal or standard spacing.

In order to print one continuous line 5 orthogonally to the transport direction of the print carrier 6, nozzles of the same ordinal number are actuated simultaneously. The process begins with nozzles having the highest ordinal number, 117, 127, 137. Once the recording carrier 6 has covered a distance equivalent to a spacing $\Delta s$ from the next nozzles 116', 126, 136 in the transport direction, the latter nozzles are actuated. After a travel distance $s=6\times\Delta s$, all 21 nozzles 111–137 will have been actuated once. At a constant speed, As would be equivalent to a fixed time interval $\Delta t$.

If the above-described conditions are adhered to, then the associated printout 5 is a continuous straight line 5 composed of 21 printed dots 501–521.

Figure 2:
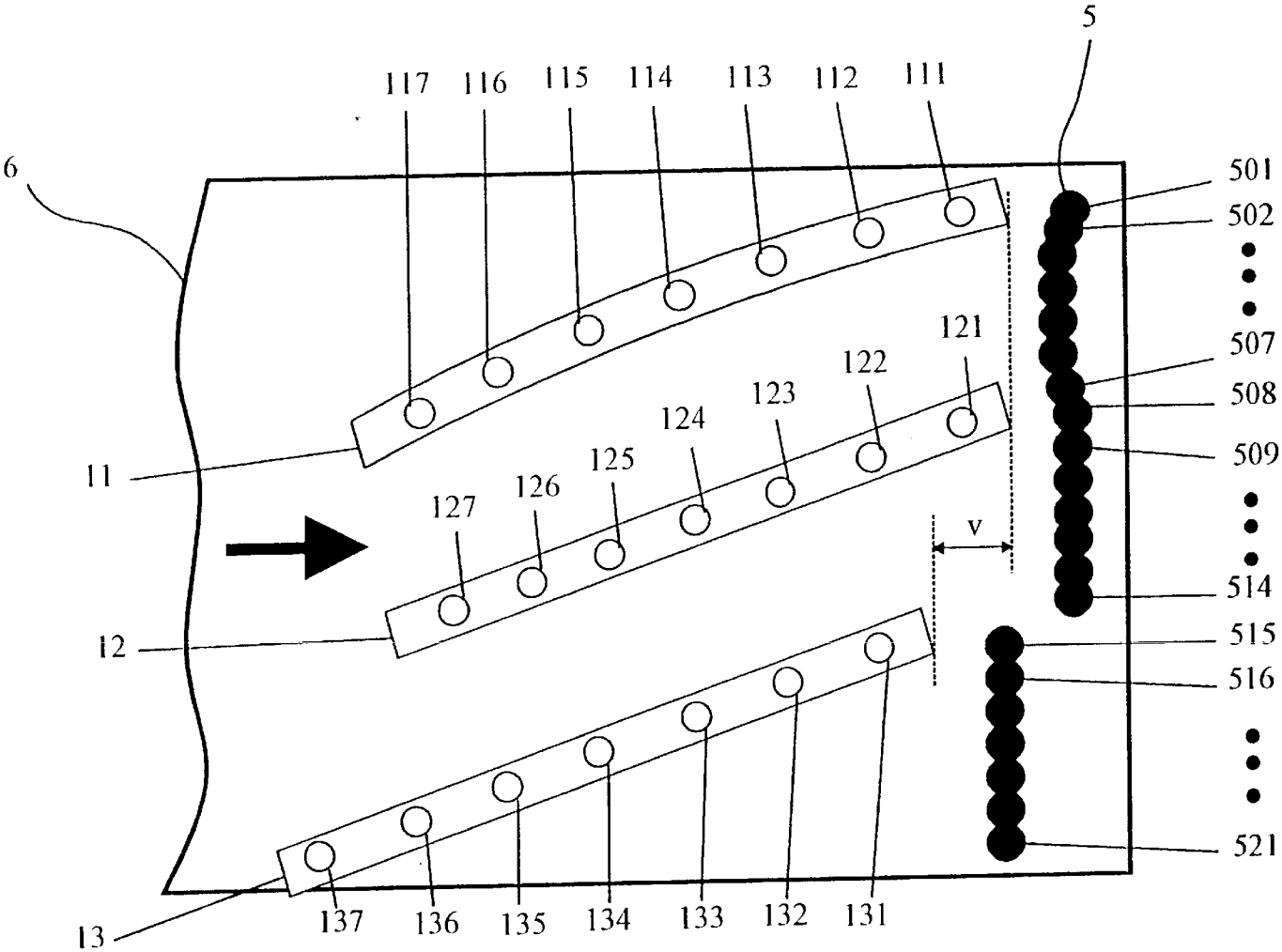
FIG. 2 is a view similar to FIG. 1 of a defective nozzle field with an associated line printed.

FIG. 2 shows a combination of all of the possible errors in a defective nozzle field and the associated so-called line printout 5. The reasons for these errors may be production-dictated deviations in the length of the individual module which is shown for the module 12, tension-caused warping thereof which is shown for the module 11, and production tolerances of a front panel and its slots that is shown for the module 13. Another source would be errors caused by installation tolerances for a fastening of the ink jet print head. Corresponding deviations from a continuous straight line can therefore be seen in the printout 5.

Figure 3:
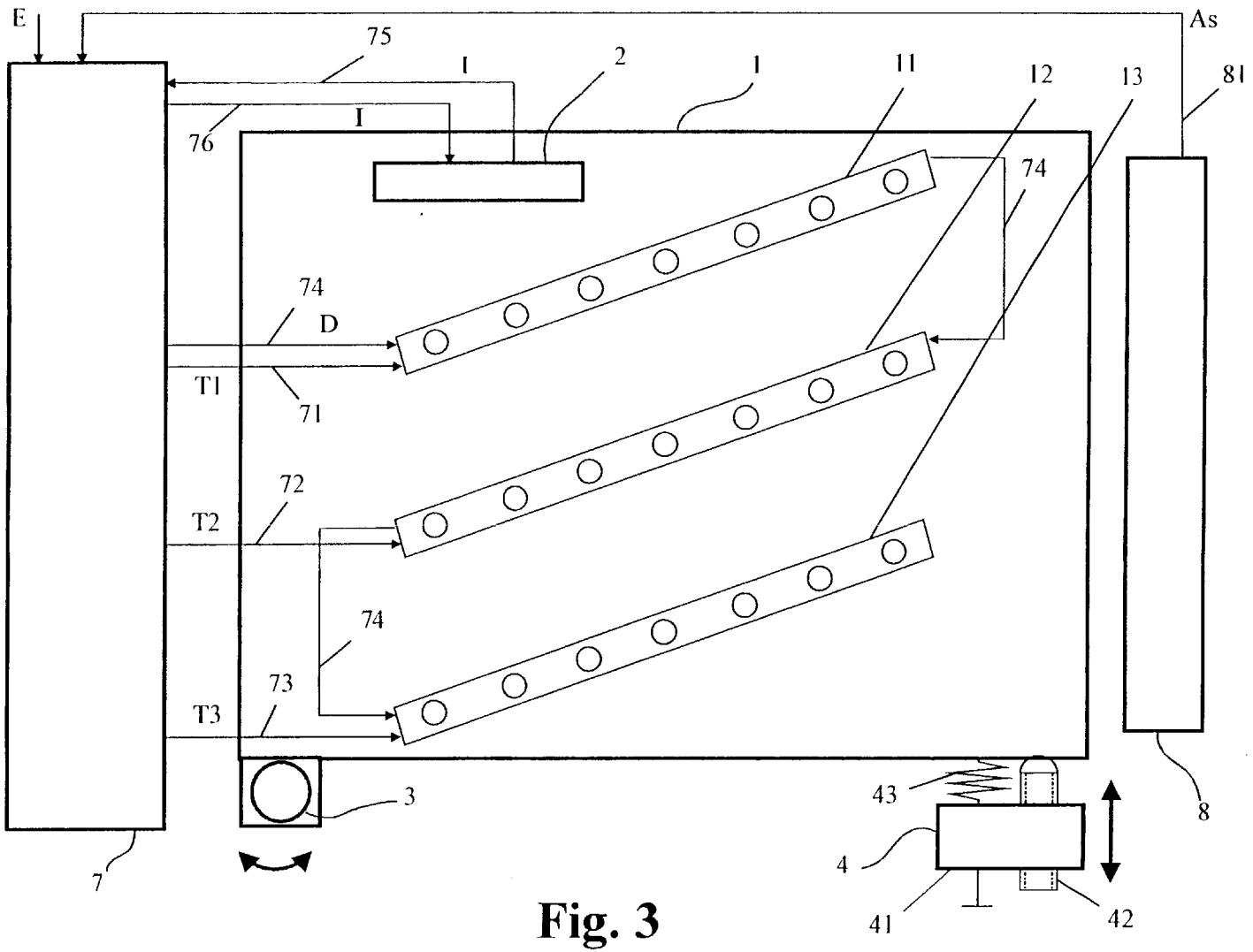
FIG. 3 is a top-plan view of a basic illustration of an apparatus for performing the method of the invention.

FIG. 3 shows an apparatus for performing the method of the invention which includes an ink jet print head 1, a memory 2, a shaft 3, an adjusting device 4, a printing control computer 7 and a scanner 8.

The ink jet print head 1 is composed of three modules 11, 12, 13. The modules 11, 12, 13 are disposed one above the other in alignment, according to the non-interlaced principle. The ink jet print head 1 is rotatably supported on the shaft 3 within an adjustment range. A bearing for the shaft 3 may be formed directly onto a housing of the ink jet print head 1 or contained indirectly in a crossbar for receiving the ink jet print head 1.

The adjusting device 4 includes a threaded bush 41, an adjusting screw 42 and a spring 43. The adjusting device 4 is used for rotating the ink jet print head 1 within the adjustment range. The ink jet print head 1 rests in a force-locking manner on the adjusting screw 42, under the influence of the spring 43. A force-locking connection is one which connects two elements together by force external to the elements, as opposed to a form-locking connection which is provided by the shapes of the elements themselves. The adjusting device 4 can expediently also be secured to the aforementioned crossbar.

The memory 2 is an integral component of the ink jet print head 1 and is constructed as a nonvolatile read-write memory through the use of an EEPROM. The memory 2 is connected to the printing control computer 7, that is the microprocessor, through an outgoing data line 75 and an incoming data line 76.

The first module 11 is connected to the printing control computer 7 through a clock line 71 and an incoming data line 74. The second module 12 is connected to the printing control computer through a clock line 72. The third module 13 is connected to the printing control computer 7, through a clock line 73.

In the embodiment shown, print data D are fed serially into the modules 11, 12, 13. The data line 74 therefore runs in a loop from the printing control computer 7 through the module 11 to the module 12 and to the module 13. An alternative is for the print data D to be input directly into each module 11, 12, 13 on a parallel bus.

In a conventional non-illustrated way, the modules 11, 12, 13 are provided with a commercially available driver circuit with a shift register and latches preceding linking members. Actor circuits for the nozzles are tripped at the proper time and with the proper picture information through the use of the linking members, which are connected to the associated clock lines.

Figure 4:
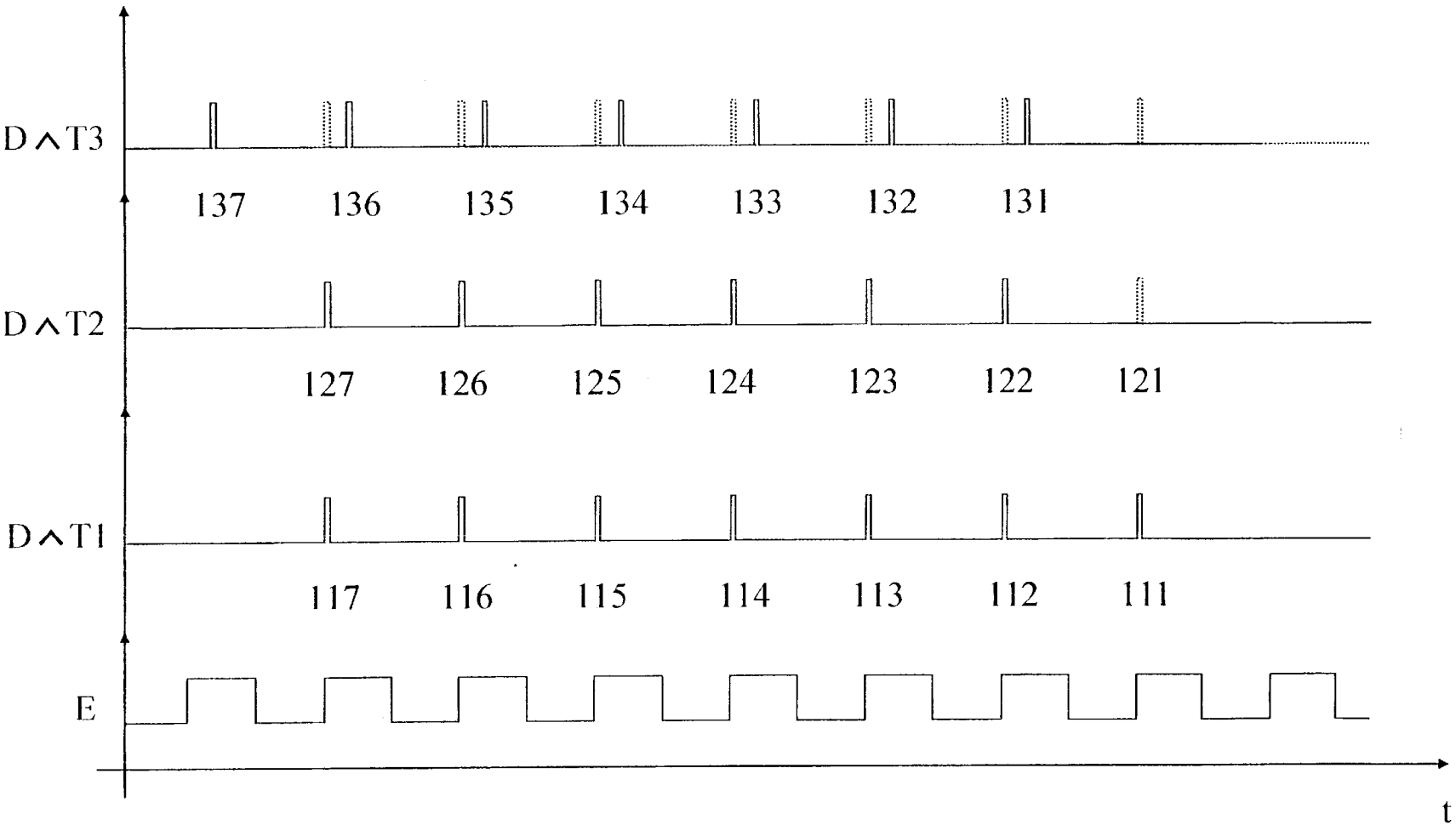
FIG. 4 is a pulse diagram for the apparatus of FIG. 4.

The printing control computer 7 is connected through a signal line 81 to a scanner 8, for generating individual print data or correction data I. The printing control computer 7 is also connected in a non-illustrated manner to an encoder, with which motion of the recording carrier 6 is detected and converted into encoder signals E for the printing control computer 7. Reference is also made to FIG. 4 in this regard.

According to the invention, even before the ink jet print head 1 is installed in final form in a printing apparatus, gaps at a transition from the modules 11, 12 to the modules 12, 13 are first externally compensated for mechanically by rotation of the ink jet print head 1 and are stored in memory, after test printouts have been evaluated. Next, with the aid of the printing control computer 7, individual print data I in the form of correction data for the ink jet print head 1 are generated electronically and stored in a nonvolatile manner internally of the print head.

The procedure in detail is described below.

First, a first test printout is created with print data D that correspond to a virtual straight printed line 5 of dots, which extends orthogonally to the transport direction of the recording carrier 6. If the ink jet print head 1 is defective, the printed line 5 of dots accordingly deviates from a continuous straight line, as is seen by comparing FIGS. 1 and 2.

The test printout is assessed visually for gaps in the printed dot line 5 at the transitional regions of the printed dots generated by the individual modules 11, 12, 13, that is printed dots 501–507, 508–514, and 515–521.

If there are gaps between applicable printed dots, such as a height offset v between the printed dot 514 and the printed dot 515, which is an offset outside the standard Δd, then the ink jet print head 1 is rotated about the shaft 3 through the use of the adjusting device 4, in particular the adjusting screw 42, until the gap between the two printed dots 514, 515 is closed. The result is checked through the use of a second test printout and if necessary a further correction is performed.

An angle of rotation is at the same time stored mechanically through the use of the setting of the adjusting screw 42. The angle of rotation can be seen by comparing dashed and continuous edges of the recording carrier 6 shown in FIG. 5.

Once the mechanical calibration has been concluded, the printed line 5 of dots is scanned by the scanner 8. The outcome of the scanning is fed in the form of scanning signals As over the signal line 81 to the printing control computer 7, in which the scanning signals As are compared with the print data D and clock signals T1, T2, T3 with which the printed line 5 of dots was made. Pulse trains are shown in dashed lines in FIG. 4.

The outcome of the comparison is fed in the form of the individual print data I into the memory 2 which is integrated with the ink jet print head 1. The individual print data I are used in a printing operation in the printing control computer 7 to create corrected clock signals T1, T2, T3 for triggering the ink jet print head 1. These signals are synchronized with the encoder signals E, as is seen by the pulse trains shown in solid lines in FIG. 4.

In this case the corrected clock signals T1, T2, T3 are fed serially and in a module-oriented manner into the ink jet print head 1 through the associated clock lines 71, 72, 73. The print data D are all fed serially over the data line 74 into the modules 11, 12, 13. The corrected clock signals T1, T2, T3 can also be fed individually in a nozzle-oriented manner to the ink jet print head 1. This would require a parallel bus for the clock lines.

If overlaps of printed dots 507, 508 in the printed line of dots caused by the rotation are found in the test printout after the mechanical calibration, then the applicable individual print data I contain information for excluding one nozzle 121 from the printing. See FIG. 4 in this regard.

Figure 5:
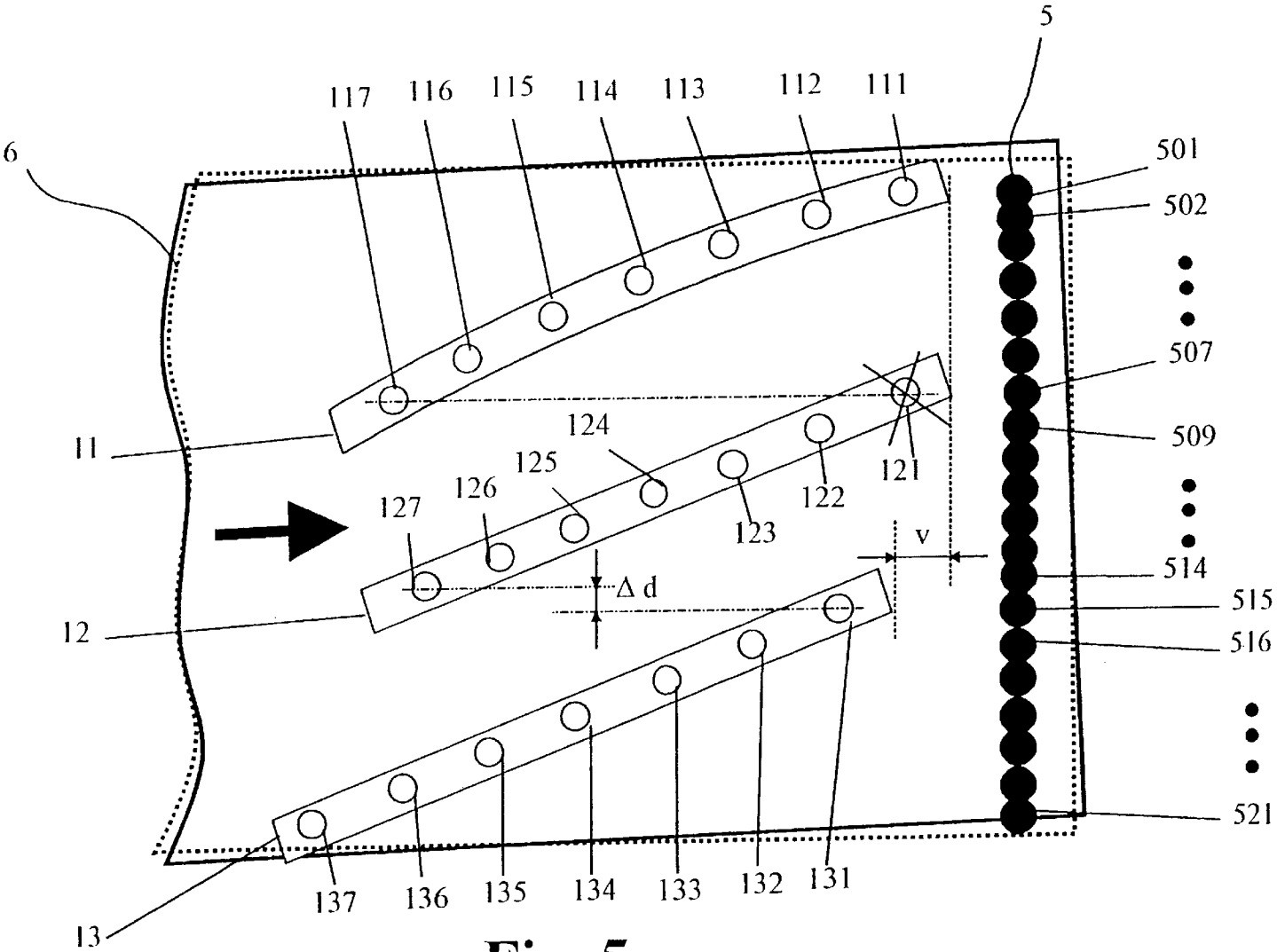
FIG. 5 is a view of the nozzle field according to FIG. 2 with the corrected line printout.

FIG. 5 shows a line printout for the defective nozzle field of FIG. 2, having been corrected by the procedure described above. In this case, the nozzle 121 is electronically blocked from participating in the printing operation.

We claim:

1. A method for tolerance compensation in an ink jet print head, which comprises:

providing an ink jet print head with a plurality of obliquely disposed and mutually equidistant modules having first effective nozzles intended to lie on a line orthogonal to a transport direction of a print carrier;

assessing test printouts, then mechanically compensating for existing gaps at transitions from one module to another by a rotation of the ink jet print head, and externally storing the gaps in memory as a correction value, before a final installation of the ink jet print head in a printing device;

supplying the individual data with information for excluding a nozzle from a printing operation, if the printed dots overlap because of the rotation of the ink jet print head; and then controlling the ink jet print head with a printing control computer by electronically generating individual print data as correction data for the ink jet print head and storing the print data in a nonvolatile manner within the ink jet print head.

2. The method according to claim 1, which comprises providing the modules according to the non-interlaced principle.

3. A method for tolerance compensation in an ink jet print head, which comprises:

providing an ink jet print head with a plurality of obliquely disposed and mutually equidistant modules having first effective nozzles intended to lie on a line orthogonal to a transport direction of a print carrier;

creating a first test printout with print data corresponding to a virtual straight printed line of dots extending orthogonally to the transport direction of the recording carrier;

visually checking the test printout for gaps in the printed line of dots at transitional regions of the printed dots generated by the individual modules;

rotating the ink jet print head about a shaft with an adjusting device, if gaps are present between applicable printed dots, for closing the gaps between the applicable printed dots;

checking an outcome of a second test printout, making another correction if necessary, and mechanically storing the rotation of the adjusting device in memory by setting an adjustment screw in the adjusting device;

scanning the printed line of dots with a scanner after a conclusion of a mechanical calibration, delivering scanning signals to the printing control computer and comparing the scanning signals with tripping print data in the printing control computer;

storing an outcome of the comparison in memory, in the form of individual print data, in a memory integrated with the ink jet print head and constructed as a nonvolatile read-write EEPROM memory before a final installation of the ink jet print head in a printing device; and using the individual print data, during a printing operation, in the printing control computer to generate corrected clock signals for triggering the ink jet print head.

4. The method according to claim 3, which comprises supplying the corrected clock signals serially and in a module-oriented manner to the ink jet print head.

5. The method according to claim 3, which comprises supplying the corrected clock signals in the form of a parallel bus and in a nozzle-oriented manner to the ink jet print head.

* * * * *